US007318239B2

(12) United States Patent
Wood et al.

(10) Patent No.: US 7,318,239 B2
(45) Date of Patent: Jan. 15, 2008

(54) WATERFOWL HUNTER'S DUAL-FUNCTION TOP GARMENTS

(76) Inventors: Michael Tate Wood, 2223 Angel Crest Cir., Cordova, TN (US) 38016; Bobby Windham, Jr., 6790 Oak Forest Dr., Olive Branch, MS (US) 38654

( * ) Notice: Subject to any disclaimer, the term of this patent is extended or adjusted under 35 U.S.C. 154(b) by 564 days.

(21) Appl. No.: 10/839,000

(22) Filed: May 5, 2004

(65) Prior Publication Data

US 2004/0221360 A1 Nov. 11, 2004

Related U.S. Application Data

(60) Provisional application No. 60/467,939, filed on May 5, 2003, provisional application No. 60/486,322, filed on Jul. 11, 2003.

(51) Int. Cl.
*A41D 13/00* (2006.01)

(52) U.S. Cl. ..... 2/69; 2/82; 2/108; 2/85; 2/93; 2/113; 2/115

(58) Field of Classification Search ..... 2/113–115, 2/69, 69.5, 105, 106, 85, 93, 94, 95, 88, 86, 2/81, 82, 900, 904, 2.15, 2.16, 46, 48, 51, 2/123, 125, 108
See application file for complete search history.

(56) References Cited

U.S. PATENT DOCUMENTS 1,015,231 A * 1/1912 Jacobs ..... 2/115
1,530,543 A * 3/1925 Comer ..... 2/115
5,088,116 A * 2/1992 Gould ..... 2/82
5,388,271 A * 2/1995 Sessoms ..... 2/115
5,526,532 A * 6/1996 Willard ..... 2/69
5,758,363 A * 6/1998 Winfree ..... 2/122
6,272,684 B1 * 8/2001 Shih ..... 2/87
6,668,383 B2 * 12/2003 Rausch et al. ..... 2/82

OTHER PUBLICATIONS

REI-Fall and Winter Adventures Catalog, Fall-1998, pp. 10 and 16, REI Switchback Parka and THe BiPolar TEch II Jacket.*

* cited by examiner

*Primary Examiner*—Gloria M. Hale
(74) *Attorney, Agent, or Firm*—Ober/Kaler; Royal W. Craig

(57) ABSTRACT

A top garment for waterfowl hunters and other outdoorsmen that has the attributes of breathable layering garments beneath the sternum (where waders are generally worn) and the attributes of a coat above the sternum (where waders do not extend). The top portion of the top garment, above the sternum, is made of waterproof and noiseless materials, such as micro-fleece, with an insulated inner lining and a tailored action back and underarm gussets for a full range of motion in the arms and shoulders. The bottom portion, beneath the sternum, is made of a breathable layering material, such as fleece. The upper portion includes an option array of magnetic storage pocket(s) (or hand warmers) designed to provide the hunter with easy access to items when needed, yet to maintain the items in a secure position when not in use.

21 Claims, 4 Drawing Sheets

WATERFOWL HUNTER'S DUAL-FUNCTION TOP GARMENTS

CROSS-REFERENCE TO RELATED APPLICATIONS

The present application derives priority from U.S. Provisional Patent Application 60/467,939, filed May 5, 2003, and 60/486,322 filed Jul. 11, 2003.

BACKGROUND OF THE INVENTION

1. Field of the Invention

The present invention relates generally to specialty clothing for hunters, fisherman and other outdoorsmen and more particularly, to durable and practical dual function top outwear garment (configured as a shirt or jacket) that has the attributes of a breathable garment beneath the chest (where waders, bibs or overalls are worn) and the insulating attributes of a coat above the chest (where waders do not extend).

2. Description of the Background

Hunters, fisherman and other outdoorsmen typically wear special purpose camouflaged clothing so that they blend in with their surroundings, thus being obscured from the vision of their prey. The prior art is replete with such clothing, including jump-suits, vests, jackets, and the like, all particularly designed for outdoor sports such as hunting.

For example, U.S. Pat. No. 4,882,786 to Gross shows a hunting jacket that incorporates an arm support for carrying a gun. The jacket includes various pockets and a gun pad on the front, and a sling-type forearm support on the inside of the jacket.

U.S. Pat. No. 6,182,291 to Garvey shows a hunting vest with reversible flaps on the front and the back. Each flap is detachable with a camouflage color on one side and hunter's orange on the other side so that the hunter can display each side interchangeably. The front flap folds over pockets for protection of the contents.

U.S. Pat. No. 3,337,101 to Tombari shows a hunting vest with outside pockets for storage of shells, cartridges and the like.

U.S. Pat. No. 5,718,000 to Ost et al. shows a multi compartment, modular jacket including a vest with a vest front panel, a vest rear panel, a pair of armholes and a fastener for opening the vest. A plurality of pockets cover the outer surface of the vest. The vest has detachable sleeves, an inner and outer jacket and a plurality of pockets.

Cold-weather waterfowl hunting (ducks, geese and the like) and fishing in particular present a most difficult environment (these types of sport often take place in standing water that may at times be up to 50" deep, in diverse climate conditions). In such conditions the sportsman typically wears chest waders. Such waders are waterproof neoprene or other fabric, extend to the chest, and are supported there by suspenders. These waders are often heavily insulated. Thus, when a sportsman wears a conventional waist-length insulated coat atop chest waders, he or she suffers in two ways. First, most outdoor sportsman's coats have a water/windproof laminate or layer that inhibits breathability by a factor of 10-15 times. When worn under a non-breathable pair of waders the result can be suffocating, producing sweats, and the wearer suffers. Second, the double insulation running from the bottom of the coat to the top of the waders results in an area of extreme heat. There is a very noticeable contrast to the area above the waders which is insulated only by the coat, and is generally 10-20 degrees cooler. This contrast is very uncomfortable. Third, the doubly-insulated area is extremely bulky and greatly limits the sportsman's range of motion for firing or casting. None of the above-mentioned or any other known prior art offers a dual function top garment specifically designed for cold-weather fishing and waterfowl hunting, which functions as an insulated coat above the chest wader and as a breathable layering outer garment beneath the chest wader, to equalize the thermal conditions experienced by the sportsman and to improve the range of motion for more adept hunting and fishing.

It would be greatly advantageous to provide warm, waterproof and windproof, practical, durable, and rugged outerwear specifically designed to be worn with waders (or bibs and/or overalls) while participating in hunting waterfowl, fly-fishing or other outdoor sports. More specifically, it would be advantageous to provide a shirt and/or jacket having a top portion, that extends above the sternum, formed as an insulating layer like a coat (for upper body warmth) and a bottom portion, from the sternum to the waist, formed as a breathable layer (with no laminate) which is worn beneath the waders and equalizes the thermal conditions experienced by the wearer despite the waders, and to improve the range of motion for more adept hunting, fishing, etc. The upper portion of the jacket (above the chest wader, which extends from the sternum upwards) must be warm, waterproof and windproof to protect the sportsman from the environment, and of a design to allow it to blend in with the environment. The bottom portion of the jacket (beneath the chest wader, extending downwards from the sternum) must be of a breathable un-bulky fabric that provides comfort when worn underneath the waders.

It would also be advantageous to provide an optional array of pockets placed specially on the top garment above the bottom portion to allow use in waist-deep or higher water, as well as special magnetic closures to provide quick and easy access thereto (for secure yet readily-accessible storage above the chest waders, bibs or overall tops).

SUMMARY OF THE INVENTION

It is, therefore, an object of the present invention to design a garment with the perfect blend of waterproof and windproof, and water-resistant/breathable materials by focusing on the body's heat exertion areas.

It is another object to provide a special-purpose outdoorsman top garment to be worn under chest waders (or bibs, and/or overalls) while hunting water fowl, deer, fishing or the like, and which functions as a coat above the chest wader, extending upwards from the sternum, and as a breathable layering garment beneath the chest wader, extending downwards from the sternum, to equalize the thermal conditions experienced by the wearer and to improve the range of motion for more adept hunting, casting, etc.

It is another object to provide an outdoorsmen top garment suitable for wading, and with a variety of pockets placed specially on the top garment, on the upper portion that extends up from the sternum, above the bottom portion to allow use in waist-deep or higher water, including hand-warmer pockets as well as special magnetic closures to provide quick and easy access thereto (for secure yet readily-accessible storage).

According to the present invention, the above-described and other objects are accomplished by providing a top garment specifically designed to be worn as outerwear by hunters of waterfowl, fly-fishermen, and other outdoor sportsmen in conjunction with their chest waders (or alternatively, their bibs and/or overalls). The top garment comprises two distinct portions. The upper portion above the chest waders (the sternum and above, including the arms) is insulated for warmth and made from waterproof and windproof material (preferably in a camouflage color design for hunting and non-camo for fishing), so that the coat blends in with the surrounding environment. The lower portion beneath the chest waders (from the sternum to the waist) is made of a breathable layering material, such as fleece or any other non-laminated fabric to provide comfort and warmth without the bulkiness. The lower portion functions comfortably with chest waders when worn there beneath. An optional array of pockets are placed specially on the top garment above the lower portion to allow use in waist-deep or higher water, as Well as special magnetic closures to provide quick and easy access thereto (for secure yet readily-accessible storage) to warm the hands or to hold personal items. The top garment can be worn under chest waders, bibs, or overalls while hunting water fowl, deer, fishing or the like as it functions as a breathable garment there beneath, and yet functions as a coat above the chest wader, thereby equalizing the thermal conditions experienced by the wearer and improving the range of motion for more adept hunting, casting, etc.

BRIEF DESCRIPTION OF THE DRAWINGS

Other objects, features, and advantages of the present invention will become more apparent from the following detailed description of the preferred embodiments and certain modifications thereof when taken together with the accompanying drawings in which.

DETAILED DESCRIPTION OF THE PREFERRED EMBODIMENT

The dual function top garment of the present invention is especially suited for outdoor activity in or around cold water where waders are typically worn, such as for instance waterfowl hunting, fly-fishing and the like. The top garment may be implemented either as a shirt or jacket, and in either case it comprises two distinct portions with distinct functions: an upper portion above the chest waders, extending from the sternum upwards, and a lower portion beneath the chest waders, extending from the sternum to the waist.

Figure 1:
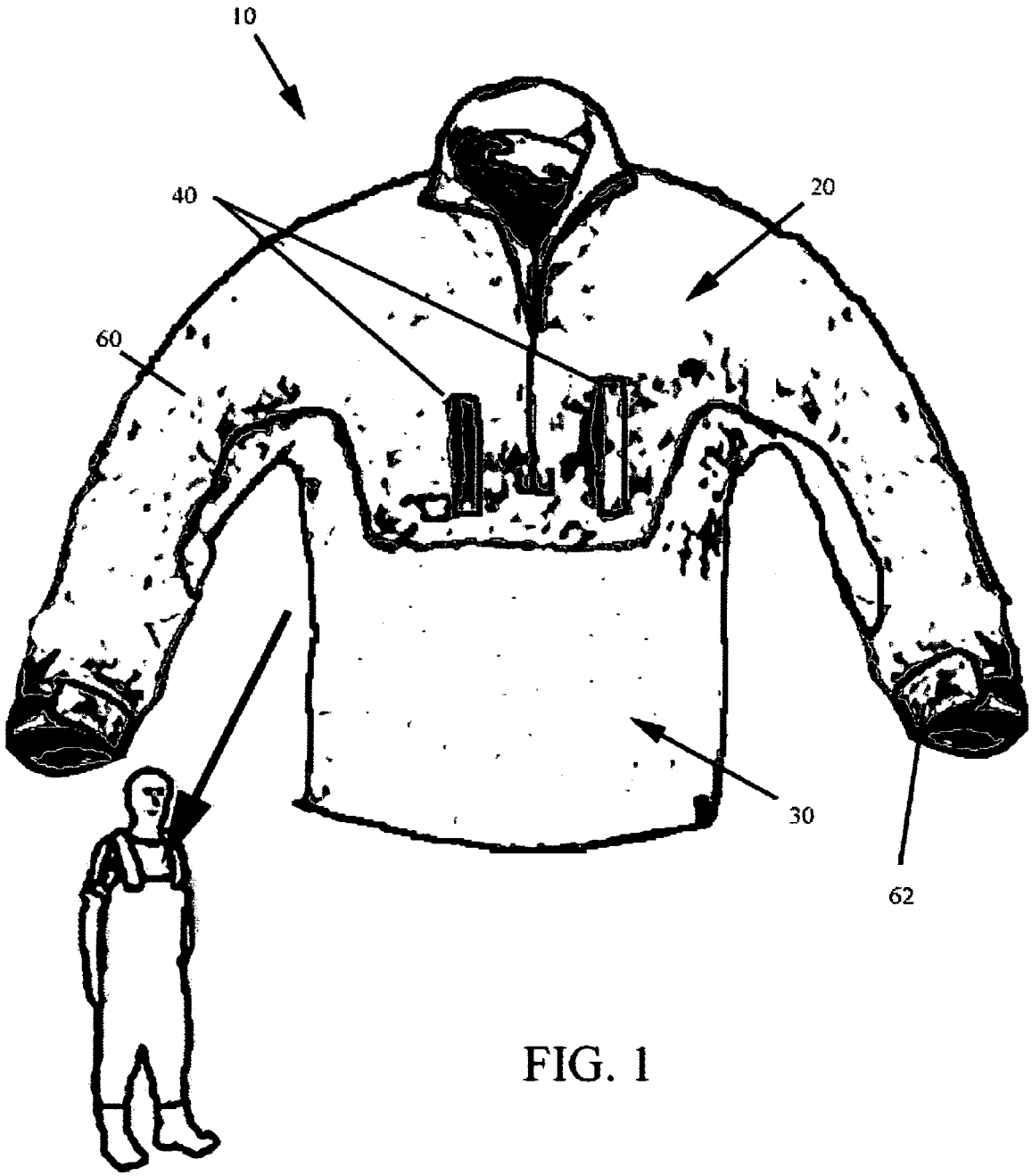
FIG. 1 is a front view of a dual function top garment 10 for waterfowl hunting, fly-fishing and the like according to the present invention with quarter-zip collar.

FIG. 1 is a front view of the dual function top garment 10 according to the present invention (here a jacket with quarter-zip collar), with an inset illustration of a sportsman wearing standard chest waders to show the context. The upper portion 20 of top garment 10 protrudes above the chest waders (from the sternum and above, including the arms) and comprises a waterproof and windproof shell with interior insulation for warmth, and preferably bearing a camouflage color design so that the coat blends in with the surrounding environment. Specifically, the upper portion 20 is formed as a lined outer shell, the shell being a 100% waterproof and windproof (or waterproof and windproof-laminated) fabric microfiber material. The water-proof and windproof shell may be lined with insulation (such as or fleece, cotton, etc.) of various weights, or not at all when implemented in a shirt. When an insulating lining is used it is preferably 100% polyester fleece. The lining may be polyester microfleece (a specially selected and commercially-available non-pilling fleece fabric designed to eliminate weight and bulk). A polyester fleece liner provides exceptionally soft skin contact and is pill-resistant for years of wear. It also wicks moisture away from the skin. The 100% fleece is preferred because it is a high-density quiet fabric, i.e., it does not rustle or make any other noise when a hunter moves, thus eliminating the risk of the ducks or geese hearing the movements of the hunter. All seams are preferably taped to ensure complete waterproofing even in the strongest downpour, although taped seams are considered optional and unnecessary when windproof but no waterproofing is desired. It is also possible to use a pattern that minimizes seams so that taping is not required. Moreover, there are modern fabrics and thread combinations which allow the thread to swell to create a waterproof seam.

The lower portion 30 of the dual function top garment 10 is made of any breathable non-laminated fabric material (to the exclusion of any waterproof or windproof laminated fabrics or non-breathable materials). This provides comfort and warmth without the bulkiness. A suitable fabric is 100% anti-pill fleece, optionally treated with a water repellant agent. Durable Water Repellant (DWR) is the preferred form of water repellant treatment, if desired. DWR in most instances is a silicon or fluorocarbon based treatment designed to create a hydrophobic condition on the exterior of the garment. The DWR binds to the garment fibers and prevents water absorption and saturation of the core fabric. Water will bead and roll away from DWR treated fabrics. Available both as a wash in or spray on, there are a variety of suitable DWRs such as Nikwax TX-Direct, 3M Scotchgard or Tectron. Without the DWR the fleece lower portion 30 would become soaked and heavy.

The lower portion 30 begins slightly below the underarms and extends to waist level, exposing all heat exertion areas. Specifically, the lower portion 30 extends over: 1) the inside portion of the upper arms; 2) the underarms; 3) the left and right torso side areas to the underarms; and 4) front and back torso areas below the sternum and back areas. These separate and distinct torso areas of lower portion 30 extend beneath chest waders (or bibs/overalls) providing the hunter or fly-fisherman with the comfort of fleece beneath the chest waders and the warmth and weather-resistance of a coat above the chest waders. This all-in one dual function top garment functions as an outer garment and yet when used in conjunction with chest waders eliminates the need to wear layered garments over and under the waders.

The upper portion 20 of the top garment 10 is formed with patterned loose-fitting sleeves 60 for the waterfowl hunter or fly-fisherman to freely practice their sport in a water environment. The sleeves 60 extend to distal cuffs 62, and each of the cuffs 62 may optionally include a strap (not shown)

encircling the cuff 62 and bindable to themselves via an adhesive gripping application, such as Velcro®, to loosen or tighten the cuffs 62 to the wearer's desired tightness. The cuffs 62 themselves are preferably formed of a synthetic elastomer, such as Neoprene, enveloped in an outer elasticized fabric shell. The elastomeric inner cuff fits snugly around the wrist, which prevents dripping water from decoys or fishing tackle from getting inside the coat sleeve 60, yet retains the warmth and dryness on the inside of the sleeve.

The top garment 10 may be provided with a variety of collar formats, for example, a quarter-length zipper (as shown), or a half-length zipper, full-length zipper, or simply an unzippered turtleneck or mock turtleneck as a matter of design choice. Moreover, the top garment 10 may be equipped with a permanent hood, removable hood or roll-up hood.

Figure 2:
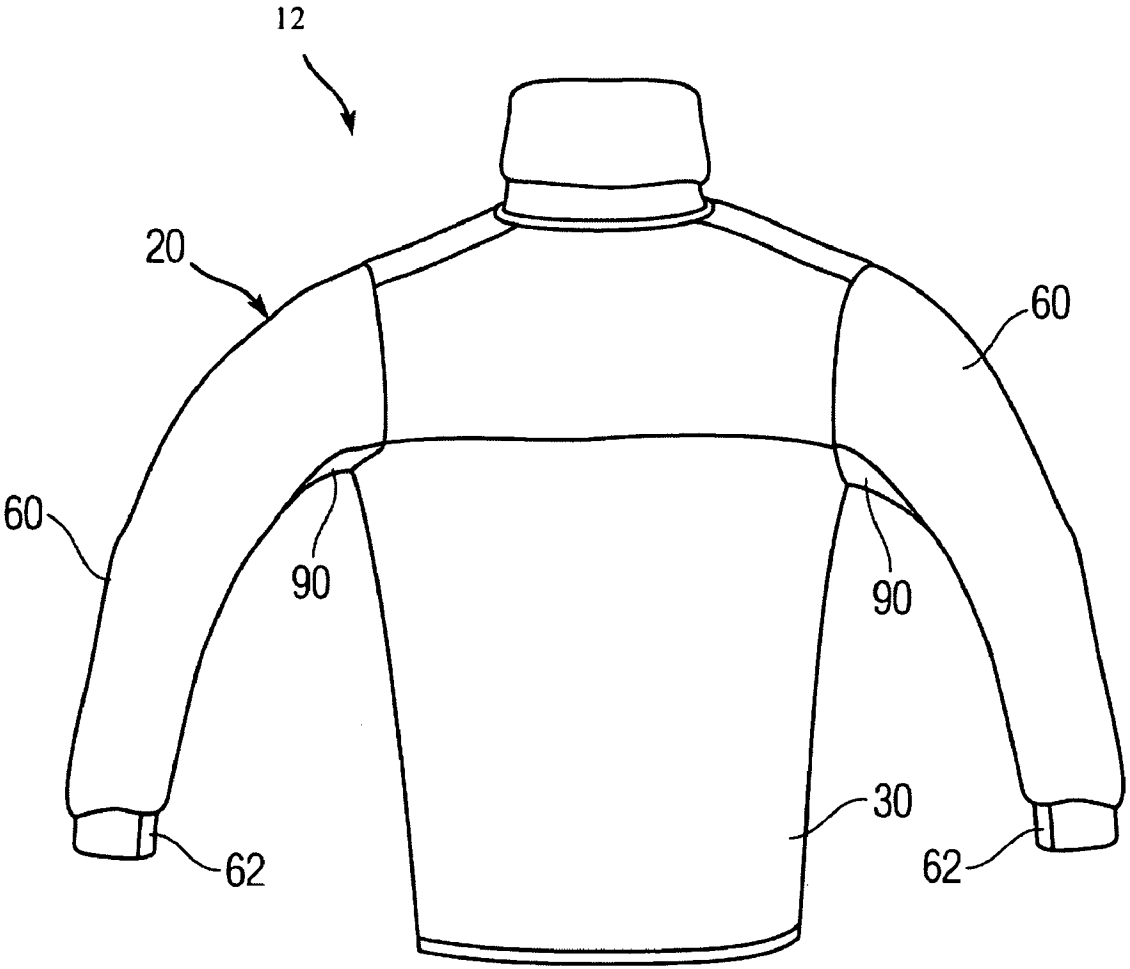
FIG. 2 is a front view of an alternate embodiment of the waterfowl hunter's dual function top garment 12 according to the present invention with turtle-neck collar.

FIG. 2 is a front view of an alternate embodiment of the waterfowl hunter's dual function top garment 12 according to the present invention with turtle-neck collar. It is likewise designed to be used as an outerwear garment as above.

It is also critical for fisherman and waterfowl hunters to keep warm while out in the cold wet marshes, and yet have freedom of movement in the arms and shoulders, to allow a hunter to quickly mount his gun and aim at a fast flying bird, or a fisherman to cast freely. To accommodate this need, the sleeves 60 may be joined at the upper portion 20 of top garment 10 via optional integral underarm gussets 90 (best seen in FIG. 2) that are tailored for maximum range of motion of the arms and shoulders.

The upper portion 20 may be equipped with an optional array of pockets specifically designed for waterfowl hunting and/or fishing by special placement on the top garment (above the waterline), including hand warmer pockets and storage pockets with specialized magnetic closures to provide quick and easy access, and a unique configuration for secure storage of tackle or waterfowl hunting items, including duck calls, etc.

Figure 3:
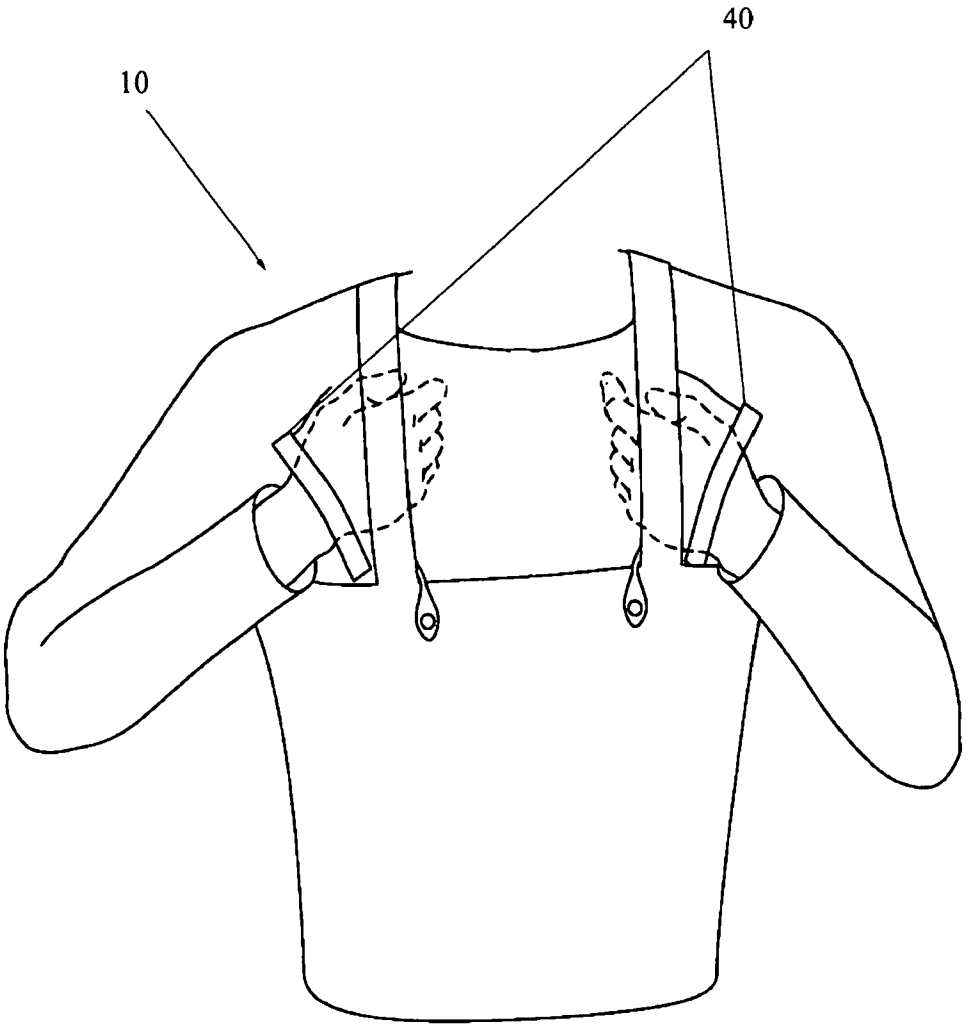
FIG. 3 illustrates two fleece-lined hand-warmer pockets 40 located on opposing sides of the upper portion 20 of the top garment 10.

FIG. 3 illustrates two fleece-lined hand-warmer pockets 40 located on opposing sides of the upper portion 20 of the top garment 10. The hand-warmer pockets 40 open through the outer shell at the breast (above the chest waders) into fleece-lined hand enclosures, and the openings of hand-warmer pockets 40 are angled within a range of from 15-20 degrees upward for upward insertion of the hunter's hands, and for comfortably warming his hands in a cross-chest posture while wading in cold waist-deep or higher water. The angle is important because it facilitates the sportsman's quick insertion and removal of his hands when necessary. These hand-warmer pockets 40 are particularly useful when wearing the chest-high waders over the bottom portion 30 of the top garment 10.

Figure 4:
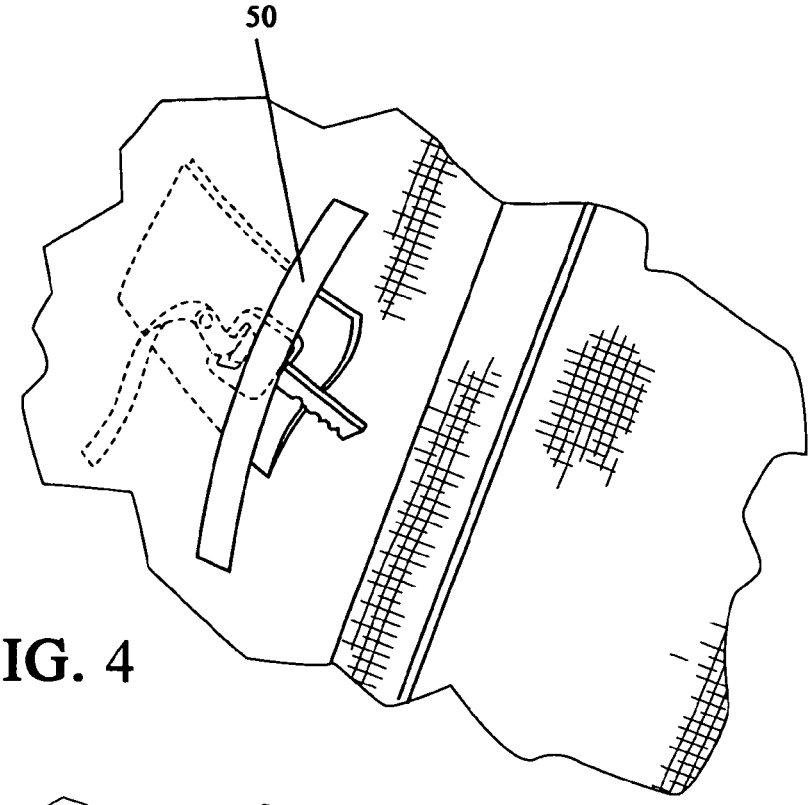
FIG. 4 is a perspective drawing of the zippered pouch 54 positioned high on the top garment 10 on one side of the breast above the chest waders.

In addition to (or alternatively), with reference to FIG. 4, a zippered pouch 50 may be positioned high on the top garment 10 on one side of the breast above the chest waders. The zippered pouch 50 opens through the outer shell of the upper portion 20 to an inner enclosure that runs horizontally away from the zipper. Zippered pouch 50 is readily accessible from the outside of the coat for storing the sportsman's license, keys, wallet, wireless phone, or the like, during the trip. The location and the zipper of pouch 50 keep the hunter's personal items high, dry and secure and more easily accessible while wearing waders, etc.

Figure 5:
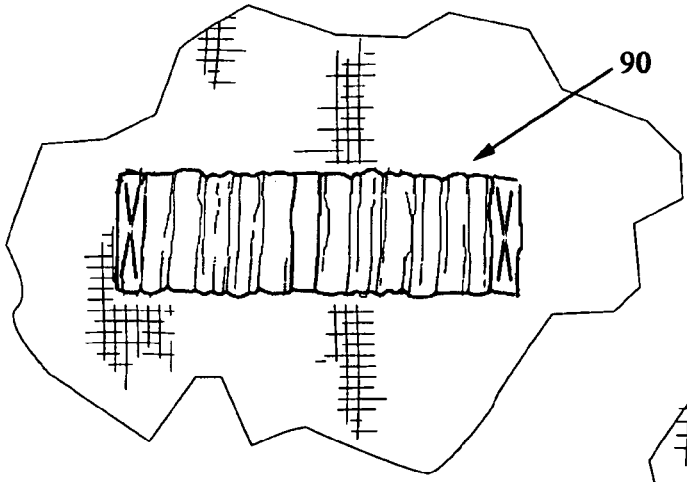
FIG. 5 is a perspective drawing of an optional call separator 90 attached to the face of the garment 10 for holding one particular game call and for maintaining it in a ready-to-use position.
Figure 6:
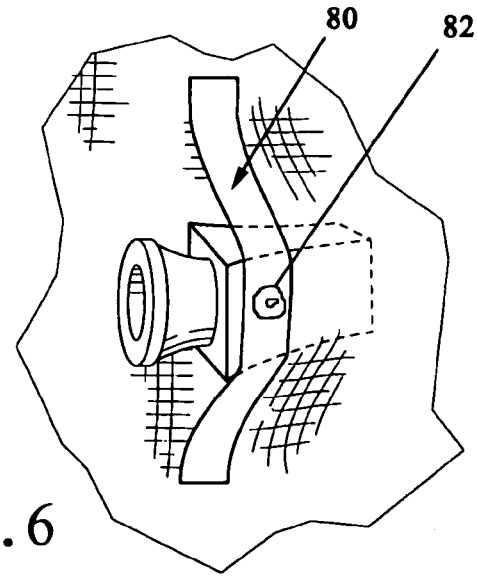
FIG. 6 is a perspective illustration of a lateral game-call pocket 80 located on the outside of the top garment 14 at the breast for holding other assorted duck and other game calls.

Referring to FIG. 5, an optional call separator 90 may be attached to the face of the coat for holding one particular game call and for maintaining it in a ready-to-use position. It is not uncommon for ducks to fly in view for a while and then disappear for a while. As a result, the waterfowl hunter does not always have his call ready in his hand. When the ducks or geese suddenly appear, the hunter must quickly grab his call and oftentimes he inadvertently grabs the wrong call or looks away from the birds to select the correct call and may miss an opportunity to shoot. The call separator 90 eliminates these opportunities for error by providing a secure specific location for a particular one of the hunter's favorite calls. This allows the hunter to grab the correct call when needed without looking to find the location. The call separator 90 also works for deer hunter grunt calls. It enables the hunter to turn his head and blow the grunt call without moving his hands and potentially alerting the deer. The call separator 90 further comprises an elastic band sewn inside an expanding fabric sleeve. The sleeve is sewn to the outer shell of upper portion of top garment 10, above the chest waders, at both ends to form an expandable collar for supporting one duck call. The hunter places his primary call in the separator 90 during the hunt so that it remains secure and separated, and back-up calls go into game call pocket 80. When finished, the primary call is returned to the game call pocket 80 for more secure storage and transport.

As seen in FIG. G, a lateral game-call pocket 80 may be located on the outside of the top garment 10 at the breast, generally on the opposing side as the zippered pouch 50 and directly beneath the call separator 90, for holding other assorted duck and other game calls. The game call pocket 80 opens laterally through the outer shell to an inner enclosure that runs horizontally away from the opening. The game call pocket 80 is a quick and easy storage area for game calls, and it houses and protects the hunter's calls to prevent clanging together and the possible loss of their reed stoppers. The game call pocket 80 also serves to protect the calls and call reeds from call freeze. A duck call's reed can accumulate saliva. As a result, the cold and wind exposure causes the saliva to freeze on the reed preventing blowing the call. This call pocket 80 helps reduce the exposure to the cold reducing call/reed freeze. The game call pocket 80 comprises a sleeved pocket formed for lateral ingress and closed by a hemmed flap with a magnetic snap closure 82. The opening of duck call pocket 80 can be releasably sealed by magnetic closure 82, which couples together for central closure in the hemmed flap. The magnetic closure 82 comprises a set of opposing permanent magnet snaps that interlock solely by magnetic force, thereby allowing duck calls to be stored therein for ready access by the hunter with his free hand. One of the snaps of magnetic closure 82 is sewn to the underside of the hemmed flap; and the other is sewn directly facing to the shell of top garment 10. The greatest advantage of the magnetic closure 82 is its ability to minimize the sound of putting your call up. By having a magnet instead of a zipper or Velcro™, the user can silently stow the calls and control the closure 82 for complete silence. Moreover, many game calls make unwanted noises when jostled about, but confining them to a call stow-way call pocket 82 near the chest area allows storage without making a noise. In addition, the magnetic closure 82 minimizes the amount of dexterity needed to store or remove calls, and the upward placement of the duck call pocket 80 keeps the calls dry and safe. Again, this feature is helpful while wearing waders over the coat 10 because it keeps the calls high on the chest and easily accessible.

The above-described top garment is specifically designed to provide warm, waterproof and/or windproof, practical, durable, and rugged outerwear to be worn while hunting waterfowl, deer or other game, or fishing. The two distinct portions: the upper portion above the chest waders provides warmth and protection from the environment, and the lower portion beneath the chest waders provides breathable warmth, comfort, and ease of motion. Moreover, the specific array of storage features and compartments are each specifically designed for waterfowl hunting, fishing and the like with all their above-described tribulations. The special placement of each compartment on the top garment facilitates use in waist deep or higher water, and the types of closures provide quick and easy access as well as secure storage of all necessary tackle and/or waterfowl hunting items, including duck calls, etc.

Having described the present invention, in detail it will be appreciated that variations in the materials and construction may be incorporated without departing from the inventive concept presented herein.

We claim:

1. A dual function hunting top garment for use with chest waders, bibs and overalls, comprising:

an upper portion, positioned at the sternum and above and including a pair of arms, all substantially comprised of a waterproof and windproof material; and a lower portion attached to said upper portion and extending downward from there, from the chest to the waist, for wear underneath said chest waders, bibs or overalls, the lower portion comprising breathable non-waterproof and non-windproof material.

2. The dual function hunting top garment for use with chest waders according to claim 1, wherein said lower portion further comprises a breathable non-laminated material.

3. The dual function hunting top garment for use with chest waders according to claim 2, wherein said lower portion further comprises a breathable water resistant non-laminated material.

4. The dual function hunting top garment for use with chest waders according to claim 1, wherein said upper portion further comprises an outer shell made of waterproof and windproof material, and an insulated inner lining.

5. The dual function hunting top garment for use with chest waders according to claim 4, wherein said upper portion further comprises an outer shell formed of 100% waterproof material.

6. The dual function hunting top garment for use with chest waders according to claim 5, wherein said insulated inner lining of said upper portion further comprises cotton fleece.

7. The dual function hunting top garment for use with chest waders according to claim 6, wherein said insulated inner lining of said upper portion further comprises cotton microfleece.

8. The dual function hunting top garment for use with chest waders according to claim 6, wherein said lower portion is made of a breathable material.

9. The dual function hunting top garment for use with chest waders according to claim 5, wherein said lower portion is made of fleece.

10. The dual function hunting top garment for use with chest waders according to claim 1, wherein said upper portion is adorned in a camouflage design to blend in with the surrounding environment.

11. The dual function hunting top garment for use with chest waders according to claim 1, wherein the sleeves of the upper portion are terminated by cuffs formed of neoprene.

12. The dual function hunting top garment for use with chest waders according to claim 1, wherein the sleeves of the upper portion are terminated by adjustable cuffs.

13. The dual function hunting top garment for use with chest waders according to claim 11, wherein the cuffs are formed of fabric-covered neoprene.

14. The dual function hunting top garment for use with chest waders according to claim 12, wherein the cuffs are encircled by a hook and loop fastener to adjust the cuffs to the wearer's desired tightness.

15. The dual function hunting top garment for use with chest waders according to claim 1, wherein said upper portion is formed with integral underarm gussets tailored for maximum range of motion of the arms and shoulders.

16. The dual function hunting top garment for use with chest waders according to claim 1, wherein said upper portion is formed with at least one hand pocket situate above the breasts for use above the waterline when wading.

17. The dual function hunting top garment for use with chest waders according to claim 16, wherein said upper portion is formed with two pockets angled upward for cross-wise insertion of the hands at approximately a 30 degree offset from vertical, said pockets being to warm the hands above the waterline when wading.

18. A dual function hunting top garment for hunting and fishing, comprising:

a top portion, at the sternum and above, including the arms, comprised of an outer shell made of a waterproof and windproof shell with an insulated lining;

a lower portion, from the sternum to the waist, comprised of a breathable non-laminated material.

19. The dual function top garment for hunting and fishing according to claim 18, wherein said top portion is an insulated jacket.

20. The dual function top garment for hunting and fishing according to claim 19, wherein said top portion is a non-insulated shirt.

21. The dual function top garment for hunting and fishing according to claim 18, wherein said non-laminated material is fleece.

* * * * *